United States Patent [19]

De Korte

[11] 4,144,664

[45] Mar. 20, 1979

[54] WEATHERPROOF CHANGEABLE DISPLAY DEVICE

[76] Inventor: Peter De Korte, 329 Calvin Ct., Wyckoff, N.J. 07481

[21] Appl. No.: 852,374

[22] Filed: Nov. 17, 1977

[51] Int. Cl.[2] ..... G09F 15/00; G09F 23/00

[52] U.S. Cl. ..... 40/609; 40/10 D; 40/152.1; 40/156; 40/610

[58] Field of Search ..... 40/609, 610, 611, 606, 40/616, 152, 152.1, 154, 155, 156, 158, 10 R, 10 D, 549; 52/822, 823

[56] References Cited

U.S. PATENT DOCUMENTS

| | | | |
|---|---|---|---|
| 1,884,971 | 10/1932 | Galbraith | 40/611 |
| 3,719,000 | 3/1973 | Finger | 40/609 |
| 3,740,881 | 6/1973 | Finger | 40/609 |
| 3,970,033 | 7/1976 | Lindner et al. | 40/156 X |

*Primary Examiner*—John F. Pitrelli
*Assistant Examiner*—G. Lee Skillington
*Attorney, Agent, or Firm*—James J. Cannon, Jr.; James J. Cannon

[57] ABSTRACT

A weatherproof display device for changeable display signs to be mounted on a gasoline dispensing pump comprising a transparent weatherproof cover for holding changeable printed display cards depicting the prices and taxes applicable to the gasoline being dispensed. The device includes a thin rectangular box assembly formed by interlocking front and back panels made of a transparent material having a base assembly forming a mounting pedestal and a secured cap forming its top edge and serving as its cover. Insertion and withdrawal of the price display cards is accomplished by lifting the thin rectangular box assembly from its mounting pedestal base assembly, each of which is printed permanently with a specific set of price and tax conditions. The dimensions of each display card conform substantially to the height and width of the transparent panels, and are duplicated so as to be visible from each side. Several display cards, indicating various combinations of prices and taxes, and combined in a booklet form, may be stored safely within the display box, readily available for rearrangement as desired. The display unit may be disassembled rapidly for cleaning purposes.

2 Claims, 2 Drawing Figures

WEATHERPROOF CHANGEABLE DISPLAY DEVICE

BACKGROUND OF THE INVENTION

1. Field of the Invention

The invention pertains to the field of portable, weatherproof devices for storing and displaying changeable printed materials requiring protection from destructive environments and including means for the rapid replacement of said materials.

2. Description of the Prior Art

Retail gasoline stations commonly advertise the prices of their gasoline to the motoring public by means of display signs attached to the top of each dispensing pump. Frequently, the sign and visibility of the display and the informaton so displayed is controlled by various local, state and federal regulations, rules and statutes primarily to provide full price and tax information to the consumer. Furthermore, the consumer is very price conscious and wishes to know the price before turning off the road. Additionally, many laws enacted at the behest of consumer groups require prompt posting of continuously changing fuel prices. Hence a quick and efficient method is required to achieve this. It is a matter of economic and legal survival that these signs be legible and clearly visible to the price-conscious motorists who pass the station at speeds commonly is excess of thirty miles per hour with closest points of approach commonly exceeding twenty feet. Constant exposure to the elements can take its toll on these displays, and therefore a protective cover of some kind usually must be employed. Yet the opposing pressures exerted by inflation, competition and changing tax statutes may require daily changes of the listed prices. Thus the ideal sign should combine effective protection with ease of access and adjustment.

One commonly used prior art device approached the problem by using a one-piece transparent cover which ensheathed a display card assembly and was secured in place at two locations by winged screws . However, replacement of the cards required that the winged screws be retracted and the entire cover lifted off, with three distinct manual operations being involved. The one-piece construction of the cover made cleaning and drying of the interior difficult. In addition, the separate card assembly featured a specially molded plastic holder with angular tabs and slideways formed to accommodate individual cards corresponding to each digit of the price. Therefore in any one changing operation several cards on both sides of the display holder may have to be removed and replaced. A separate storage area for the replacement digit cards also would have to be provided.

Another prior art device eliminated the need for an all-enclosing cover by providing that the individual digit cards be made of plastic or other suitable material that could withstand the exposure to the weather and could be wiped clean of accumulated dirt. However, this limited the display to the use of specially fabricated cards, and the drawbacks associated with replacement of individual digit cards remained as well.

SUMMARY OF THE INVENTION

The object of this invention is to provide a simple, inexpensive, easily maintainable device for displaying changeable printed information in a highly visible manner suitable for out-of-doors advertising on gasoline dispensing pumps. The embodiment of this invention combines the ease of replacing the printed material with adequate protection against the destructive effects of weather. The display device, with its basic four-piece construction, is adaptable to various forms of printed matter, from professionally printed signs on paper, cardboard or plastic to hand written notices specifically created for a given situation.

The proposed invention includes two identical transparent panels, made of plastic or other suitable material, generally rectangular in shape, each of which has two pairs of integrally molded tabs, perpendicular to its surface and extending along the entire vertical dimension of the panel, generally at each edge of said panel. One pair of the tabs, parallel to each other and separated by approximately 5/16 of an inch, is located at one extreme edge of the panel such that the outermost tab forms one continuous surface with the main panel, although at a right angle to said panel. The other pair of tabs, likewise parallel, but separated by only 3/16 of an inch, is located at the opposite edge of the panel but the outer most tab is not contiguous with the edge but is set inward approximately 3/16 of an inch therefrom. When the two identical panels are assembled with the tabs on each panel pointing inward toward the opposing panel, and with one panel rotated 180 degrees with respect to the other, one tab on each panel will fit into the 3/16 of an inch space between tabs on the other panel, in a tongue-and-groove fashion, to form a thin rectangular box. This box will be open on both the top and bottom, but will have enclosed vertical sides formed by the previously described continguous tabs. The assembly is held together by friction due to the close tolerances between the connecting tabs and their corresponding grooves.

An upright, U-shaped, grooved receptacle, mounted on a flat horizontal base, tightly receives the open bottomed rectangular box to maintain it in a stable vertical position for display purposes and provides a weathertight closure for its base. Said base can have appropriate holes to accommodate hardware for attachment to a gasoline pump. A cap, having interior dimensions slightly larger than the thickness and width of the box, slips over the open top of said box to serve as its cover and to complete the weatherproof seal of the unit. Short, perpendicularly extending tabs, generally at each end of the cap, help to retain the cap in position on the box. These tabs tightly engage corresponding vertical channels at either edge of the box formed by the particular arrangement of the interlocking tongues and grooves previously described. Similar short or perpendicularly extending tabs evenly displaced along the underside of the cap and along the interior base of the U-shaped receptacle serve to maintain even spacing between the two rectangular panels.

A properly sequenced and indexed set of price cards bound, for example, in a spiral-type notebook, can be stored in the display unit with proper price information exhibited through each panel. To change the prices, the entire box assembly is lifted off easily from its mounting pedestal without need for removing any hardware, the cards are flipped to the appropriate page, and the box is replaced. For cleaning purposes, the box is lifted from its base receptacle, the cap is removed, the two mating panels are separated and then the parts are wiped or washed clean.

The device of this invention may also be used for other advertising and display purposes and is not intended to be limited to motor vehicle fuel prices.

DESCRIPTION OF THE PREFERRED EMBODIMENT

Figure 1:
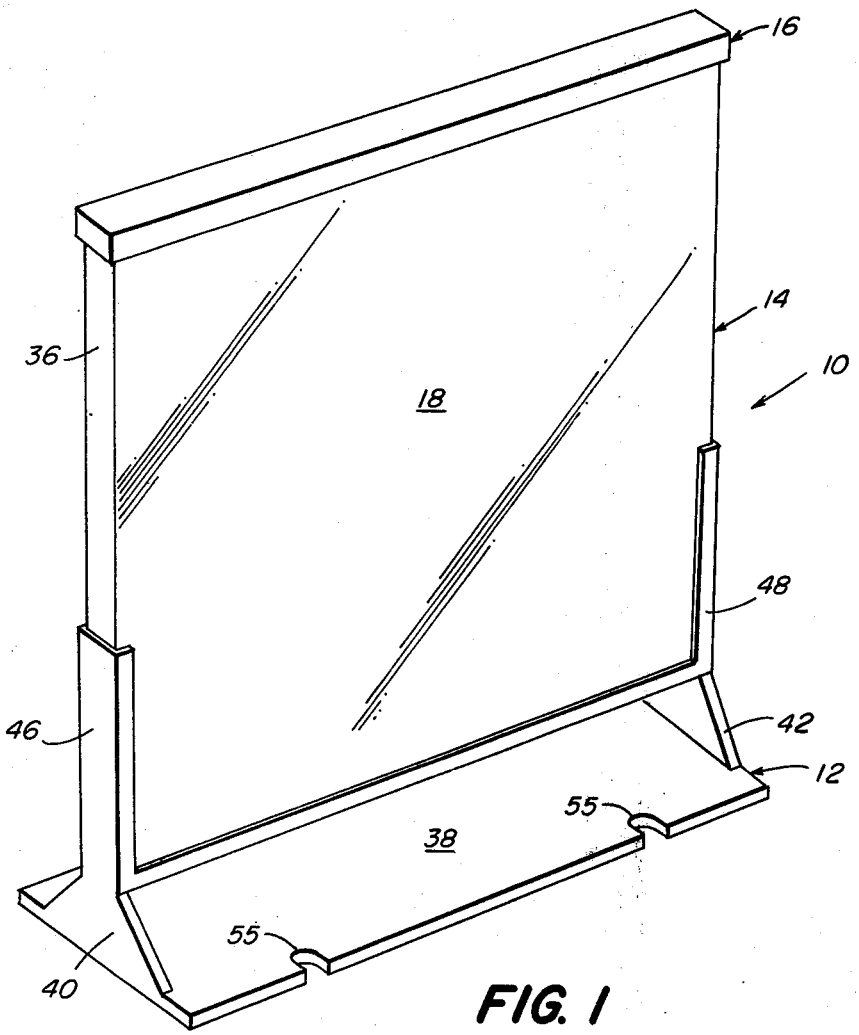
FIG. 1 is an olique plan view of an exemplary embodiment of the invention.
Figure 2:
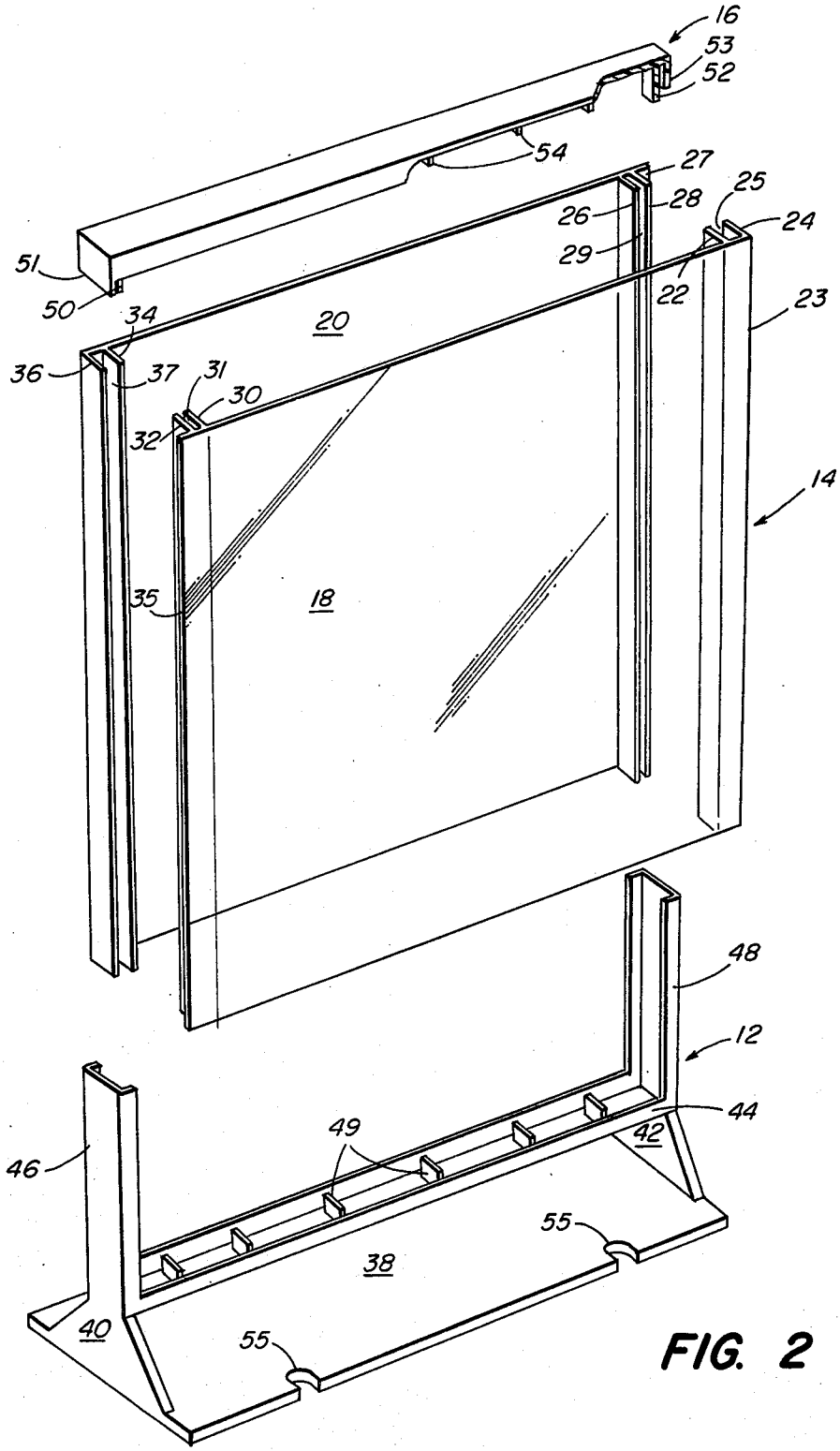
FIG. 2 is an exploded view of the oblique plan view of FIG. 1.

With reference now to the drawing and more particularly to FIG. 1 thereof, there is shown an oblique plan view of an assembled embodiment of the invention. The changeable display device, denoted generally by reference number 10, consists of three basic assemblies: base assembly 12, box assembly 14 and cap assembly 16, all of which are illustrated in the exploded view of FIG. 2. Referring now to FIG. 2, box assembly 14 comprises two separate, identically constructed components, front panel 18 and rear panel 20, so designated for convenience. Said panels 18, 20 are generally rectangular in shape, transparent, made of plastic or other suitable material and of sufficient size to accommodate lettered signs capable of being seen at distances of approximately one hundred feet, or the minimum distance required by applicable municipal, state and/or federal regulations. Integrally molded with panel 18, and perpendicular to its flat surface, are two tabs 22, 24, which run in the vertical direction, parallel to each to each other and parallel also to the right hand edge 23 of panel 18. Tab 24 contacts panel 18 precisely at edge 23, forming a sharp 90 degree angle. Tab 22 is inward of tab 24 at a distance of approximately 5/16 of an inch. The configuration of tabs 22 and 24 is duplicated on identical panel 20 by tabs 34 and 36. Tabs 30 and 32 are likewise integrally molded with panel 18 and perpendicular thereto. Tab 32 extends in a vertical direction parallel to the left-hand edge 35 of panel 18 and approximately 3/16 of an inch inward from edge 35. Tab 30 runs parallel to tab 32, 3/16 of an inch further inward therefrom. The configuration of tabs 30 and 32 is duplicated at identical panel 20 by tabs 26 and 28. Tab 28 runs in a vertical direction parallel to right hand edge 27 of panel 20 and approximately 3/16 of an inch inward from edge 27. Tab 26 runs parallel to tab 26, 3/16 of an inch further inward therefrom.

Box assembly 14 is produced by mating panels 18 and 20. In so doing, tab 22 tightly engages the slot 29 between tabs 26 and 28 and tab 34 tightly engages the slot 31 between tabs 30 and 32. The gripping forces exerted on tabs 22 and 34 keep box assembly 14 held together. In the assembled state, two vertical channels 25, 37, will have been formed, defined by tabs 24 and 28, and by tabs 32 and 36 respectively.

Base assembly 12 is a one-piece molded assembly, made of an appropriately strong plastic, comprising a flat base plate 38, two triangular support struts 40, 42, a horizontal support channel 44, and two vertical support channels 46, 48. The interior width of horizontal channel 44 and the interior depths of channels 44, 46 and 48 conform generally to the exterior width and depth respectively of box assembly 14. A plurality of vertical separators are spaced in horizontal channel to maintain even spaced relation between panels 18, 20. Thus when box assembly 14 is inserted into the U-shaped receptacle formed by channels 44, 46 and 48, said box is held firmly in a stable upright position. Base plate 38 can be fitted with appropriate hardware for mounting onto a gasoline pump, such as holes 55 to receive screws.

Cap assembly 16 is similarly of a one-piece molded construction, basically resembling a shallow, narrow, open bottomed rectangular box, with two downwardly extending tabs 50, 52 one at either end. Tabs 50, 52 in conjunction with ends 51, 53 of cap 16 fit snugly over side walls 36, 24 of box assembly 14 and in effect form a channel. Cap 16 fits snugly around the open top of box assembly 14, and tabs 50, 52 fit snugly into the corresponding vertical channels 37 and 25. A plurality of vertical separators 54 also extend downwardly from the interior of cap 16 to maintain an even spaced relation between panels 18, 20.

The changeable sign display device of the present invention is simple to manufacture and install, requiring minimum of parts. It is also remarkably simple to use. The distributor can preprint a booklet containing anticipated price and tax variations and distribute the booklet to the various service stations. As new changes come into effect, the attendant has only to remove the box and cap assemblies from the base assembly, remove the booklet, flip to the appropriate new page, reinsert the book and replace the box and cap assemblies in the base pedestal. Human error is minimized and the distributor is assured that all stations are posting the information required by law to be posted.

The device of this invention may also be used for other advertising and display purposes and is not intended to be limited to motor vehicle fuel prices.

While the invention has been illustrated and described in one embodiment, it is recognized that variations and changes may be made therein without departing from the invention set forth in the claims.

I claim:

1. A weatherproof display device for changeable display signs for posting the prices and taxes applicable to a commodity comprising:

a base assembly having a flat base plate, two triangular support struts rising vertically from each end of said base plate, a horizontal U-shaped channel between said triangular support struts, and two vertically oriented U-shaped support channels rising vertically from said support struts;

said base assembly being integrally formed from one piece of a strong plastic material;

a box assembly including from two substantially identical transparent panels, each of said panels having two perpendicular spaced apart tabs along a first vertical edge, the outermost of said tabs forming one side of said box-like structure; and each of said panels having two vertically extending perpendicular tabs recessed somewhat inward from a second vertical edge;

said box assembly being formed by inverting one of said transparent panels and pressing said two panels together such that said outer tabs on the first vertical edge of each panel form the vertical sidewalls of said box-like structure and said inner tabs along the first vertical edge of each panel are gripped snugly by the inner recessed tabs of the opposed panels said box assembly being inserted within said U-shaped channels of said base assembly to close its base end;

a cap assembly formed from one piece of a strong molded plastic having basically an inverted U-shaped horizontal channel whose interior width and depth dimensions correspond to the exterior dimensions of the top of said box-like structure, ends of said horizontal U-shaped channel being closed by end panels and a downward extending tab recessed slightly inward of said end panels to form a gripping channel on each end of said cap assembly;

said cap assembly fitting snugly across the top of said box-like assembly to fully enclose said box-like assembly; and said box assembly being easily removable from said base assembly to permit the insertion and removal of pricing books and signs.

2. The weatherproof display device of claim 1 wherein said upper and lower horizontal channels further include perpendicular spacing tabs to provide an even separation of the transparent panels of said box-like structure.

* * * * *